US006203962B1

(12) United States Patent
Itami et al.

(10) Patent No.: US 6,203,962 B1
(45) Date of Patent: Mar. 20, 2001

(54) ELECTROPHOTOGRAPHIC IMAGE FORMING METHOD, ELECTROPHOTOGRAPHIC IMAGE FORMING APPARATUS, AND PROCESSING CARTRIDGE AND ELECTROPHOTOGRAPHIC PHOTORECEPTOR USED THEREIN

(75) Inventors: Akihiko Itami; Takeo Oshiba; Tomoo Sakimura; Yohko Kitahara; Masahiko Kurachi; Kazuhisa Shida, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/597,800

(22) Filed: Jun. 20, 2000

(30) Foreign Application Priority Data

Jun. 24, 1999 (JP) ..... 11-178558

(51) Int. Cl.[7] ..... G03G 21/00
(52) U.S. Cl. ..... 430/125; 399/350
(58) Field of Search ..... 430/125; 399/350

(56) References Cited

U.S. PATENT DOCUMENTS 4,875,070 * 10/1989 Hattori ..... 430/125
5,604,574 * 2/1997 Matsuura et al. ..... 430/125

FOREIGN PATENT DOCUMENTS 1-99060 * 4/1989 (JP) ..... 430/125
3-33752 * 2/1991 (JP) ..... 430/125
3-172856 * 7/1991 (JP) ..... 430/125
6118681 4/1994 (JP) .

* cited by examiner

*Primary Examiner*—Ronald Martin
(74) *Attorney, Agent, or Firm*—Jordan B. Bierman; Bierman, Muserlian and Lucas

(57) ABSTRACT

An electrophotographic image forming method in which, after transferring a toner image on an electrophotographic photoreceptor onto a recording material, the residual toner on said photoreceptor is removed employing an elastic body rubber blade is disclosed. The photoreceptor has structural units exhibiting charge transport performance; also has a resin layer comprising a siloxane based resin having a crosslinked structure; said rubber blade is brought into contact with said photoreceptor in the opposite direction; and the residual toner on said photoreceptor is removed by vibrating said rubber blade at an amplitude of 10 to 200 $\mu$m

13 Claims, 3 Drawing Sheets

ELECTROPHOTOGRAPHIC IMAGE FORMING METHOD, ELECTROPHOTOGRAPHIC IMAGE FORMING APPARATUS, AND PROCESSING CARTRIDGE AND ELECTROPHOTOGRAPHIC PHOTORECEPTOR USED THEREIN

FIELD OF THE INVENTION

This invention relates to an electrophotographic image forming method, an electrophotographic image forming apparatus, a processing cartridge and an electrophotographic photoreceptor, particularly relates to an electrophotographic image forming method and an electrophotographic image forming apparatus having a process for cleaning a toner remained on an organic photoreceptor by a brush roller and an elastic rubber blade while the photoreceptor is moving, and a processing cartridge and an electrophotographic photoreceptor to be used in the apparatus.

BACKGROUND OF THE INVENTION

Recently, an organic photoreceptor containing an organic photoconductive substance is most widely used for the electrophotographic photoreceptor. The organic photoreceptor has advantages such that the material responding to various exposure light sources from visible light to infrared light can be easily developed, a material without environmental pollution can be selected and the production cost is low, compared with another photoreceptor. However, only a drawback of the organic photoreceptor is weak in the mechanical strength and the surface of the photoreceptor is deteriorated or damaged for a lot of copying or printing.

Generally, in the electrophotographic copying apparatus according to Carlson method, a photoreceptor is uniformly charged and the charge is imagewise eliminated by light exposure to form a static latent image. The static latent image is visualized by developing by a toner, and the toner is transferred to paper and fixed.

However, the toner on the photoreceptor is not all transferred and a part of the toner is remained on the photoreceptor. When the image formation process is repeated under such the condition, a high quality copied image without any contamination cannot be obtained since the latent image formation is disturbed by the influence of the remained toner. Accordingly, it is necessary to remove the remained toner. A fur brush roller, a magnetic brush roller or a blade is usually used for the cleaning means, and the blade is mainly used from the viewpoint of the performance and the structure thereof. A plate of rubber elastic material is usually used for the material of the blade.

As above-mentioned, an electrical and mechanical force are directly applied to the surface of the photoreceptor by the charging means, the developing means, the transferring means and the cleaning means. Accordingly, a high resistivity to such the forces is required to the photoreceptor. Particularly, a high resistivity to the wear or scratch formation of the surface of the photoreceptor caused by the friction, and a high mechanical durability to peel of the layer caused by an impact by intruding a foreign substance or removing a jammed paper are required. Specifically, the durability to the damage and peel of the layer the same as that of an inorganic photoreceptor is strongly demanded.

Until now, various investigations have been performed to satisfy the requirements as above-mentioned.

It has been reported regarding the mechanical durability, that the wearing property of the surface and the toner filming resistivity can be improved by using a bisphenol Z type polycarbonate resin as the binder at the surface of the organic photoreceptor. Japanese Patent Publication Open to Public Inspection (JP O.P.I.) No. 6-118681 discloses the use of a colloidal silica-containing hardenable silicone resin as the surface of the photoreceptor.

However, the photoreceptor using the bisphenol Z type polycarbonate resin is insufficient in the resistivity to the wearing and not has the sufficient durability. Besides, the surface layer of the colloidal silica-containing hardenable silicone resin is superior in the strength and is widely studied for the means for raising the anti-wearing property and the anti-scratch property which are the drawback of the OPC. However, a problem of the electricity property under a low humidity is raised when the siloxane resin is used in the surface layer. Although it has been tried for improve such the problem to reduce the surface electric conductivity by an addition of an electroconductive particle, a problem of occurring an image flowing under a high temperature and a high humidity has been raised. The inventors has found that the electricity property under a condition low temperature and low humidity can be improved by combining a charge transportable structural unit into the siloxane resin (Japanese Patent Application No. 11-70380).

However, a problem that the blade is apt to bend or warp accompanied with the raising the surface friction of the surface of photoreceptor and cleaning blade during the cleaning, as a result of incorporating the structure unit having transportable ability.

SUMMARY OF THE INVENTION

It is an object of the present invention to provide a stable and excellent electrophotographic image forming method, as well as an electrophotographic image forming apparatus, which minimizes the generation of excessive frictional force between an electrophotographic photoreceptor and an elastic body rubber blade, prevents the generation of blade curl, and is capable of effectively removing residual toner on said photoreceptor in an electrophotographic image forming method in which a residual toner on said electrophotographic photoreceptor is removed employing an elastic body rubber blade, and a processing cartridge employed in said electrophotographic image forming apparatus.

The present inventors have discovered that when an electrophotographic photoreceptor having structural units which exhibit charge transport performance as the photoreceptor and also having a resin layer, comprising a siloxane based resin having a crosslinked structure is employed, and the residual toner on said photoreceptor is removed employing a cleaning process comprising an elastic body rubber blade, the object of the present invention is achieved by controlling said elastic body rubber blade under specified conditions.

1. In an electrophotographic image forming method in which, after transferring a toner image on an electrophotographic photoreceptor onto a recording material, the residual toner on said photoreceptor is removed employing an elastic body rubber blade, an electrophotographic image forming method wherein said photoreceptor has structural units exhibiting charge transport performance; also has a resin layer comprising a siloxane based resin having a crosslinked structure; said rubber blade is brought into contact with said photoreceptor in the opposite direction; and the residual toner on said photoreceptor is removed by vibrating said rubber blade at an amplitude of 10 to 200 $\mu$m.

2. In an electrophotographic image forming method in which after transferring a toner image on an electrophotographic photoreceptor onto a recording material, the residual toner on said photoreceptor is removed employing an elastic body rubber blade, an electrophotographic image forming method wherein said photoreceptor has structural units exhibiting charge transport performance; also has a resin layer comprising a siloxane based resin having a crosslinked structure; polyurethane rubber is employed having a hardness at 25±5° C. between 65 and 80 in terms of JIS A Scale and an impact resilience at 25±0.2° C. between 20 and 75; said rubber blade is brought into contact with said photoreceptor in the opposite direction; and the residual toner on said photoreceptor thereby is removed.

3. The static friction coefficient of said elastic body rubber blade with respect to said photoreceptor is preferably no more than 1.0.

4. Said resin layer preferably comprises fine organic particles having an average particle diameter of 0.05 to 10 $\mu$m.

5. Said fine organic particles are preferably those comprising fluorine atoms.

6. Said resin layer preferably comprises antioxidants.

7. The resin layer of said photoreceptor is preferably comprised of a siloxane based resin which is obtained through reaction of an organic silicon compound having a hydroxyl group or a hydrolyzable group with a charge transferring compound having a hydroxyl group.

8. In an electrophotographic image forming apparatus in which, after transferring a toner image on an electrophotographic photoreceptor onto a recording material, the residual toner on said photoreceptor is removed employing an elastic body rubber blade, an electrophotographic image forming apparatus wherein said photoreceptor has structural units exhibiting charge transport performance and also has a resin layer comprising a siloxane based resin having a crosslinked structure; said rubber blade is brought into contact with said photoreceptor in the opposite direction; and the residual toner on said photoreceptor is removed by vibrating said rubber blade at an amplitude of 10 to 200 $\mu$m.

9. In an electrophotographic image forming apparatus in which, after transferring a toner image on an electrophotographic photoreceptor onto a recording material, the residual toner on said photoreceptor is removed employing an elastic body rubber blade, an electrophotographic image forming apparatus wherein said photoreceptor has structural units exhibiting charge transport performance; also has a resin layer comprising a siloxane based resin having a crosslinked structure; polyurethane rubber is employed having a hardness at 25±5° C. between 65 and 80 in terms of JIS A Scale and an impact resilience at 25±0.2° C. between 20 and 75,; said rubber blade is brought into contact with said photoreceptor in the opposite direction; and the residual toner on said photoreceptor is cleaned.

10. In a processing cartridge employed in an electrophotographic image forming apparatus in which, after transferring a toner image on an electrophotographic photoreceptor onto a recording material, the residual toner on said photoreceptor is removed employing an elastic body rubber blade, a processing cartridge which integrally comprises at least an electrophotographic photoreceptor having a resin layer containing a siloxane based resin having a crosslinked structure and a cleaning means in which an elastic body rubber blade employing urethane rubber having a hardness at 25±5° C. between 65 and 80 in terms of JIS A Scale and an impact resilience at 25±0.2° C. between 20 and 75, and is detachably installed in said electrophotographic image forming apparatus.

DETAILED DESCRIPTION OF THE INVENTION

The present inventors have discovered that in an electrophotographic image forming method in which a residual toner on an electrophotographic photoreceptor is removed employing an elastic body rubber blade, without excessively increasing the frictional force generated between said electrophotographic photoreceptor and said elastic body rubber blade, blade curl can be minimized; the residual toner on said photoreceptor can be sufficiently removed, and excellent non-fluctuating images can be obtained for an extended period of time.

Figure 1:
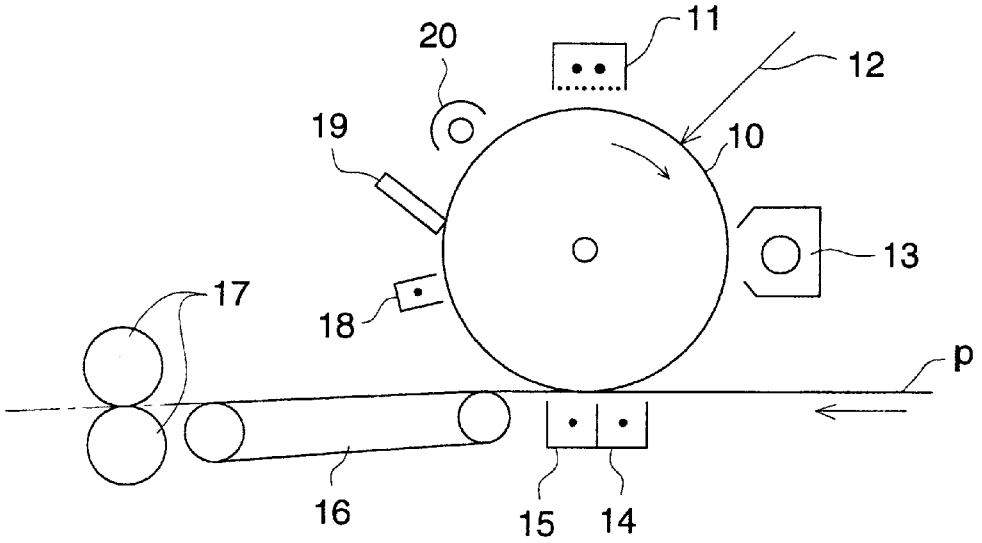
FIG. 1 shows an electrophotographic image forming method according to the invention.

FIG. 1 is a schematic view showing the electrophotographic image forming method of the present invention.

In FIG. 1, numeral 10 is an organic photoconductor drum which rotates in the arrow direction, and 11 is a charging unit which provides uniform charge onto said photoreceptor drum. Employed as charging units may be a corona discharge charging unit, a roller charging unit, or a magnetic brush charging unit. Numeral 12 is an analog image exposure or digital image exposure employing LED, LD, and the like. An electrostatic latent image is formed on said photoreceptor by said image exposure. The resulting electrostatic latent image is developed in either a contact or non-contact method, employing development unit 13, which stores a single component based or preferably a double component based developer containing fine particle toner having a volume average diameter of 3 to 15 $\mu$m, and a toner image is formed on said photoreceptor. The resulting toner image is electrostatically transferred onto a synchronously conveyed recording material p (occasionally designated as a recording sheet), employing transfer unit 14 (a transfer unit employing corona discharge or a roller transfer unit). Subsequently, said recording material, bearing the toner image, is separated employing separation electrode 15, conveyed to fixing unit 17 by conveyance means 16, and subsequently fixed.

After transfer, the photoreceptor surface is subjected to charge elimination, employing charge elimination unit 18. Thereafter, the photoreceptor surface is cleaned employing cleaning blade 19 according to the present invention, which is brought into contact with said photoreceptor 10 in the opposite direction (the contact angle (θ in FIG. 3) at the contact point of the cleaning blade with the photoreceptor is to be an acute angle). Thereafter, it is subjected to charge elimination employing charge elimination lamp 20, and prepared for the subsequent image formation.

Figure 2:
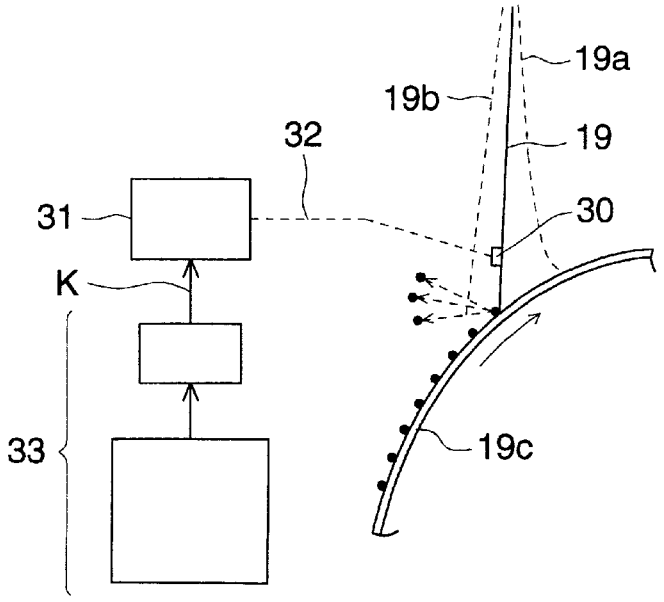
FIG. 2 shows a schematic drawing of the cleaning mechanism.

In the present invention, said cleaning blade 19 is comprised of urethane rubber, having an impact resilience at 25±0.2° C. between 20 and 75, and as shown in FIG. 2, is brought into contact with photoreceptor drum 10 in the opposite direction. Thus, accompanied with the rotation in the arrowed direction, with response to the mutual friction coefficient, the cleaning blade moves to dotted line 19*a*. However, due to said impact resilience of the blade, it is subjected to step slip to dotted line 19*b* and toner 19*c* is removed from said drum surface by said step slip, followed by cleaning.

Next, the cleaning mechanism will be described with reference to FIG. 2.

In the present invention, during performing the aforementioned step slip, vibration is carried out so that the amplitude K1, measured by the method described below, is set in the range of 10 to 200 μm. In the measurement method described below, as shown in FIG. 2, the acceleration of the blade vibration is read employing piezo sensor 30 which is located approximately 3 mm from the edge of the blade, and obtained acceleration signal 32 is inputted into computing element 31. Arithmetic processing 33 is then carried out, and the amplitude K in μm (at the position of the sensor) of the blade is outputted. The resulting data are compared to K1 of 10 to 200 μm, and it is then judged whether blade conditions are suitable or not. When the conditions are not suitable, the blade may be replaced or blade loaded weight P (in g/cm), contact angle θ°, free length 1 mm, and the like, are corrected so that image formation is carried out at the optimal conditions.

In the present invention, when the vibration amplitude of the cleaning blade is not more than 10 μm, vibration energy decreases, and toner particles pass under the aforementioned blade. As a result, background staining on images results, and other problems such as spotting, streaking, and the like, tend to be caused.

Further, when said vibration amplitude is at least 200 μm, the vibration energy of said blade becomes excessive. As a result, blade curl is formed; lateral line staining (black streaking) is formed due to jumping at the photoreceptor; and insufficient cleaning is caused.

Further, the vibration amplitude of said cleaning blade is measured as described below.

The sensor of Acceleration Detector NP-3210, manufactured by Ono Sokki Co., is mounted on the center (in the place 3 mm from the edge) of the cleaning blade. When the photoreceptor rotates at a constant speed, the amplitude is read for 10 seconds employing said sensor. Output data from said sensor are subjected to arithmetic processing, employing an "Ono Sokki CF6400 4-channel Intelligent FF Analyzer" to obtain the average of the amplitude of said vibration, which is designated as the amplitude of said blade.

Next, a description will be made employing FIG. 3, and explaining the cleaning mechanism.

In the present invention, contact load P of the blade onto the photoreceptor is preferably between 5 and 40 g/cm, while contact angle θ is preferably between 5 and 35 degrees.

Figure 3:
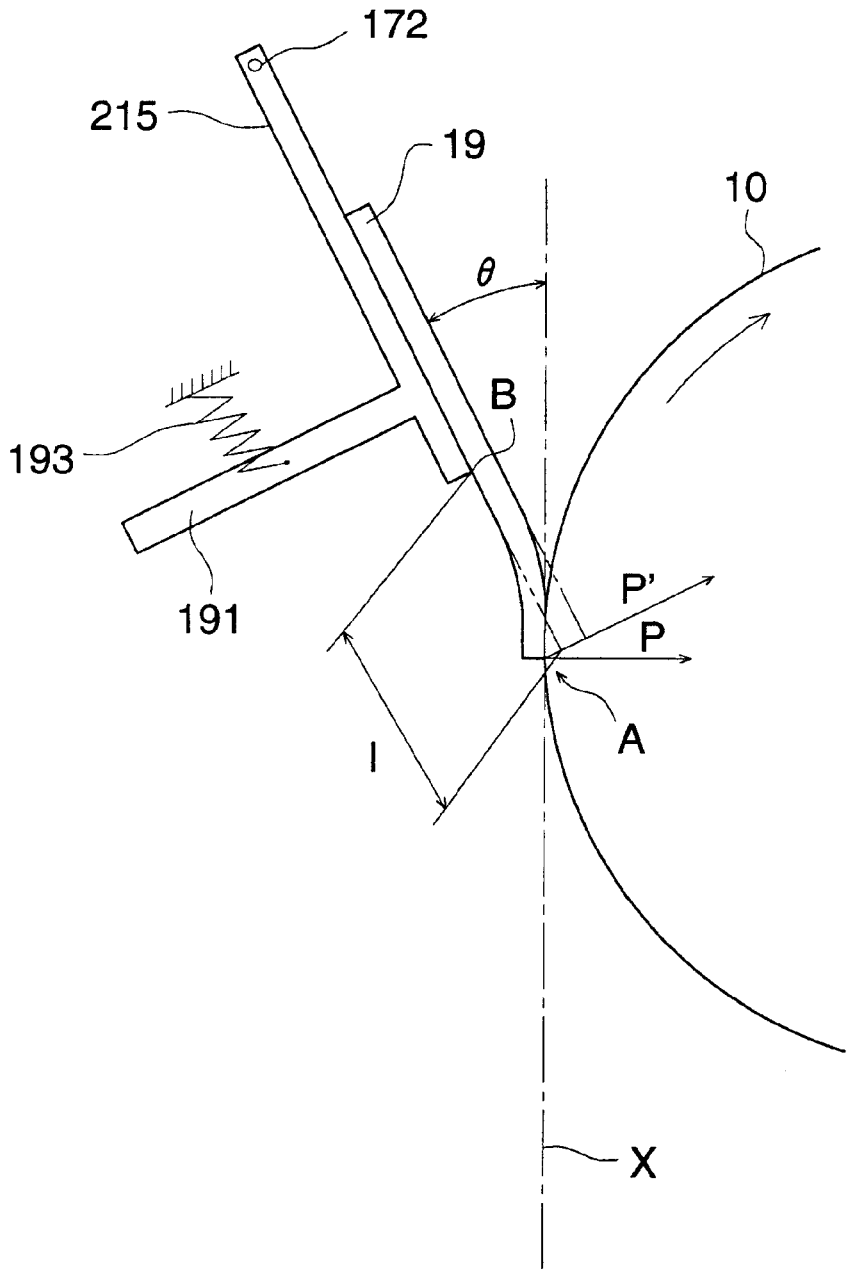
FIG. 3 shows a schematic drawing of the cleaning mechanism.

Further, as shown in FIG. 3, free length "1" of said cleaning blade is the length from the edge of holding member 191 to the edge of the blade before deformation. Said free length "1" is preferably between 6 and 15 mm. The thickness of said cleaning blade is preferably between 0.5 and 10 mm.

Contact load P is a vector value in the normal direction of pressure contact force P', when blade 19 is brought into contact with photoreceptor drum 10.

Further, contact angle θ represents the angle of the tangential line of the photoreceptor at contact point A with respect to the blade before deformation (in FIG. 3, shown by a dotted line).

In the present invention, it was discovered that when the amplitude of the elastic body rubber blade was employed by controlling it at a condition of 10 to 200 μm, no curling of the blade occurred, cleaning properties were enhanced, and the wear on the photoreceptor layer decreased.

Of physical properties of the elastic body rubber blade, which cleans the resin layer of the present invention, it is possible to more effectively retard the curling of the blade by simultaneously controlling hardness as well as impact resilience. When the JIS A hardness of the blade at 25±5° C. is no more than 65, curling of the blade tends to occur, while when it is at least 80, cleaning properties are degraded. Further, when the impact resilience exceeds 75, curling of the blade tends to occur, while when it is no more than 20, cleaning properties are degraded. When both hardness and impact resilience are simultaneously within the claims, the desired effects are obtained. Further, the impact resilience is preferably between 20 and 40. (JIS A hardness as well as impact resilience is measured based on Vulcanized Rubber Physical Test Method of JIS b6301. The unit of impact resilience values is percent.)

By controlling the hardness as well as the impact resilience of said blade, it becomes possible to maintain stable cleaning performance for an extended period of time without curling of the blade. As a result, it is possible to provide a highly durable electrophotographic image forming method which minimizes wear and exhibits excellent cleaning properties.

Still further, by incorporating fine organic particles into the resin layer, it is possible to decrease the frictional force between the photoreceptor surface and the cleaning blade. Specifically, by setting the friction coefficient between the photoreceptor and the cleaning blade at no more than 1.0, it is possible to effectively retard curling of the blade for an extended period of time.

Known as materials for the elastic body rubber blade employed in the aforementioned blade cleaning method are urethane rubber, silicone rubber, fluorine rubber, chloroprene rubber, butadiene rubber, and the like. Of these, urethane rubber is preferred due to its excellent wear resistance compared to other rubber materials. For instance, preferred urethane rubber, and the like, are, which are obtained through reaction of polycaprolactone ester with polyisocyanate, followed by hardening the resulting compound, as described in Japanese Patent Publication Open to Public Inspection No. 59-30574.

The photoreceptor of the invention is described.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

Formula A

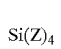

Formula B

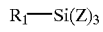

Formula C

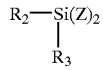

Formula D

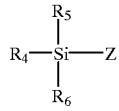

In the formulas, $R_1$ through $R_6$ are each an organic group in which a carbon atom thereof is directly boned with the silicon atom in the formula, X is a hydroxyl group or a hyrolyzable group.

When X in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl) ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a non-afluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for preparing a charge transportable polysiloxane resin, that is also called as siloxane resin having structural unit capable of charge transferring property and crosslinking structure, is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

A hydrolysis condensation product, that is prepared by subjecting the organic silicone compound mentioned above to hydrolysis under acid or base as condition and oligomerization or polymerization, may be employed as a starting material for preparing a charge transportable polysiloxane resin.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure. In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

In the invention the cross-linked siloxane resin having a charge transportable structural unit is a siloxane resin in which a chemical structure showing a drift mobility of electron or a hole (i.e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

In other definition, the charge transportable structural unit is a chemical structural unit or a residue of charge transportable compound by which an electric current caused by charge transportation can be detected by a known method for detecting the charge transportation ability such as Time-Of-Flight method.

The charge transferable compound which can form a structural unit having the charge transporting ability in the polysiloxane resin through reaction with an organic silicone compound is described.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7 -dinitrofluorene, 2,4,7-trinitrofluorenone, 2,4,5,7-tetranitrofluorenone, 9-fluorenylidenedicyanomethylenemalononitrile, polynitro-9-fliorenidene dicyanomethylenemalonodinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

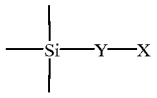

In the formula, X is a charge transportable structural unit, which bonds to Y in the formula through a carbon atom or a silicone atom constituting the structural unit. Y is a bonding group or an atom having two or more valences excluding neighboring bonding atoms (Si and C).

When Y is three or more valent atom, the bonding hand other than those each bonding with Si and C is bonded with any atom constituting the hardened resin, or has structure (group) bonding to another atom or molecular group.

In the above-mentioned formula, the atom represented by Z is preferably an oxygen atom O, a sulfur atom S or nitrogen atom N.

In the formula, Y is a nitrogen atom (N), the above-mentioned bonding group is represented by —NR—, wherein R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The above mentioned O, S or N atom is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_7—OH)_m \quad m \geqq 1$$

wherein

X: structural unit providing charge transportability $R_7$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

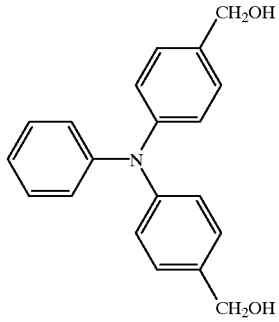

T-2

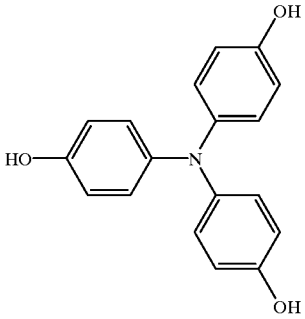

T-3

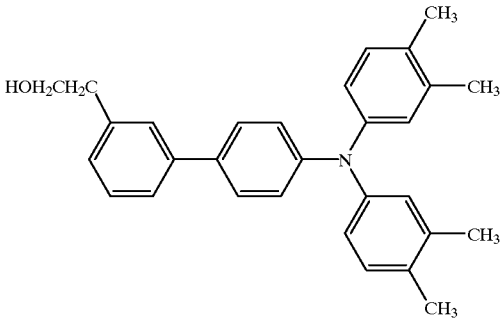

T-4

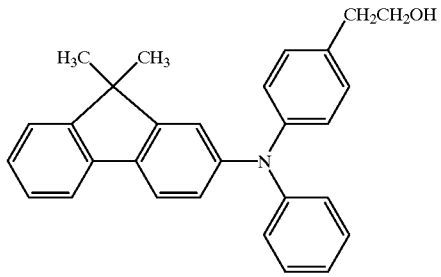

2. Hydrazine Based Compounds
H-1
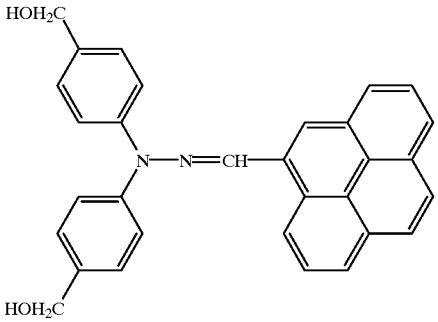
H-2
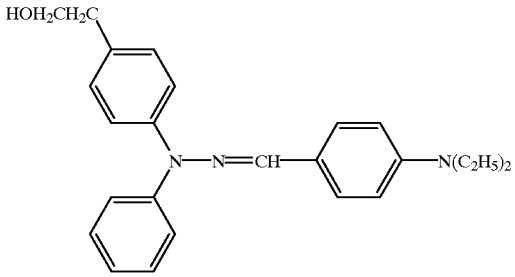
H-3
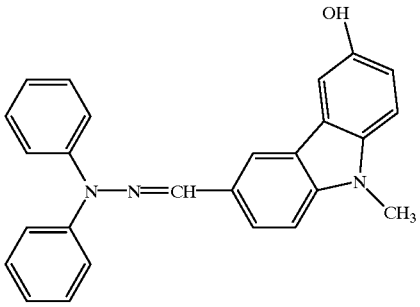
3. Stilbene Based Compounds
S-1
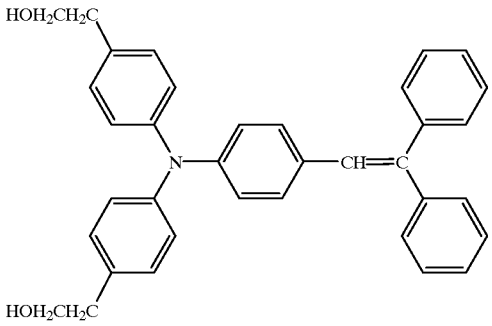
-continued
S-2
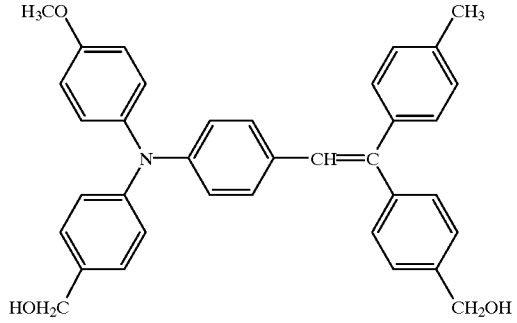
S-3
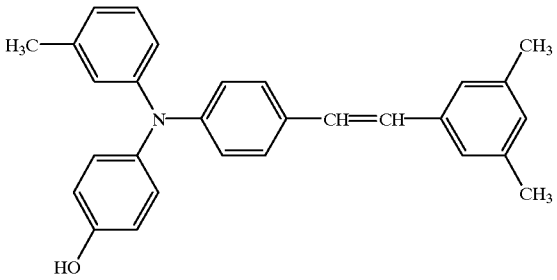
4. Benzidine Based Compounds
Be-1
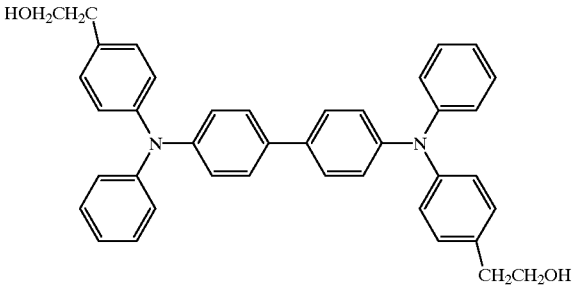
Be-2
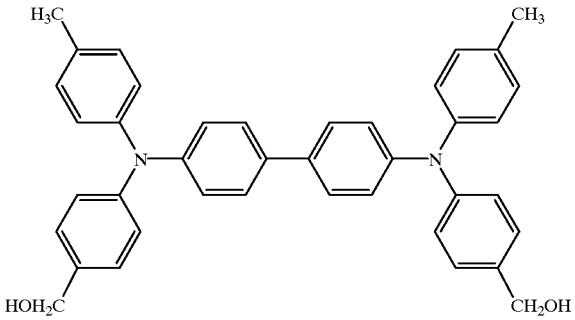

5. Butadiene Based Compounds

Bu-1

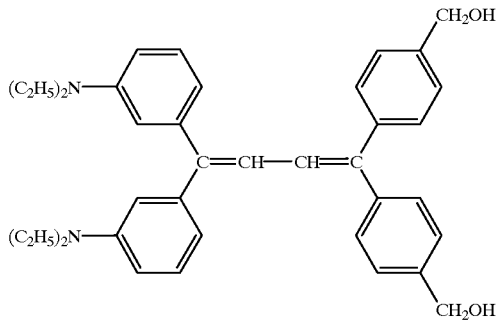

6. Other Compounds

So-1

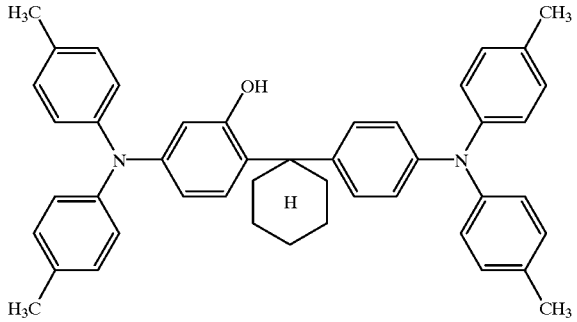

So-2

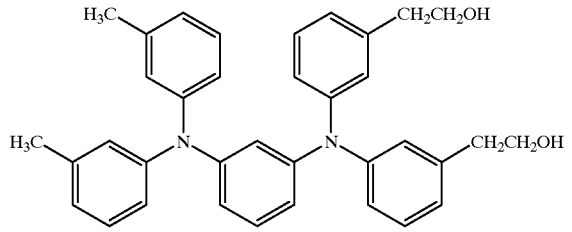

Next, a synthesis example of the charge transportable compound will be described.

Synthesis of Exemplified Compound T-1

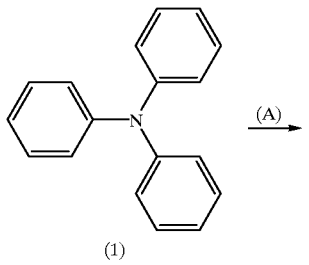

-continued

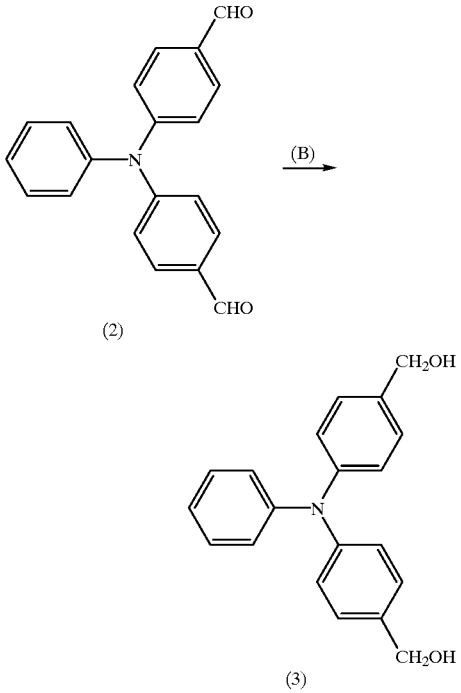

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

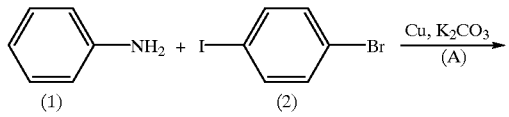

-continued

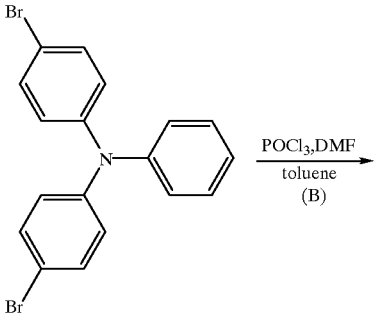

(3)

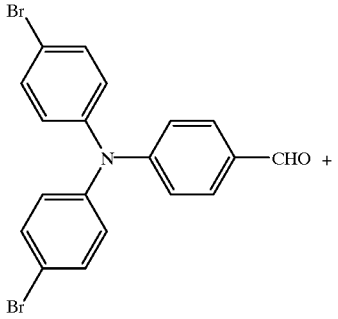

(3)

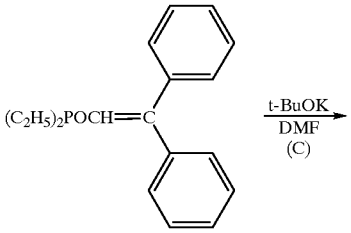

(5)

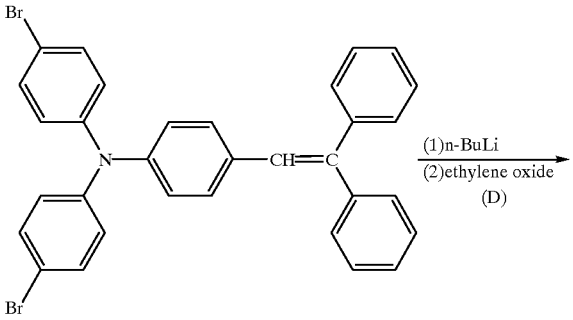

(6)

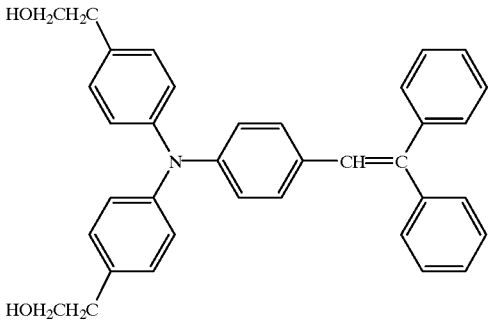

(7)

Step A

Placed in a 300 ml flask equipped with a thermometer and a stirrer were 30 g of Cu. 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_8—SH)_m \quad m \geqq 1$$

wherein

X: charge transportability providing group $R_8$: single bonding group, each of a substituted or an unsubstituted alkylene group or an arylene group m: integer of 1 to 5

Of these, listed as representative compounds are such as those described below.

V-1

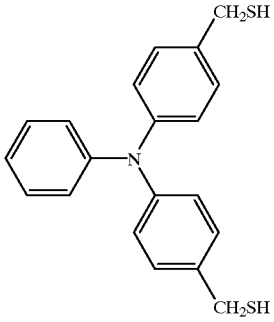

V-2

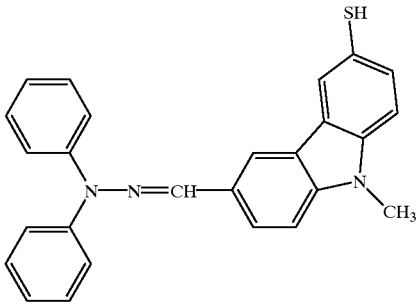

V-3

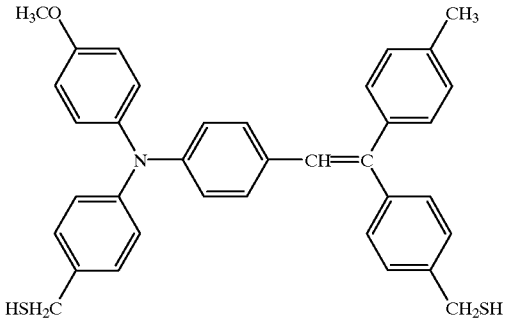

-continued

V-4

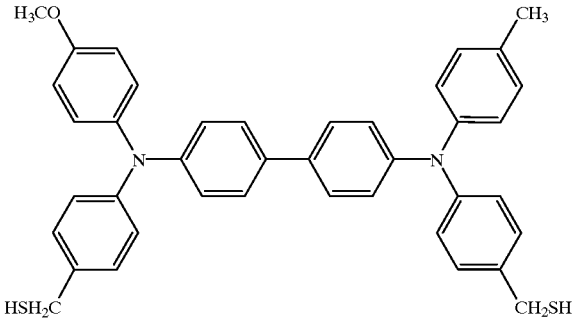

V-5

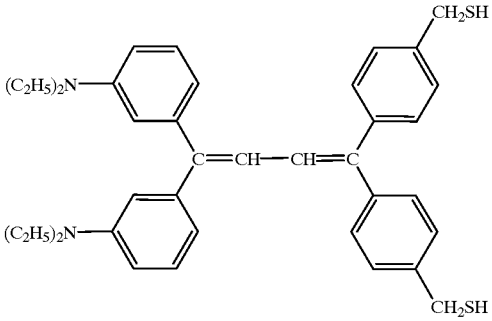

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)_m \quad m \geqq 1$$

wherein

X: charge transportability providing group $R_9$

: single bonding group, each of a substituted or an unsubstituted alkylene group or an arylene group $R_{10}$: H, a substituted or unsubstituted alkyl group, a substituted or an unsubstituted aryl group m: 1 to 5

Of these, listed as representative compounds are such as those described below.

W-1

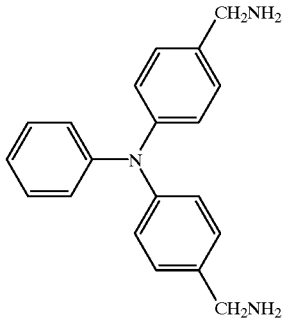

-continued

W-2

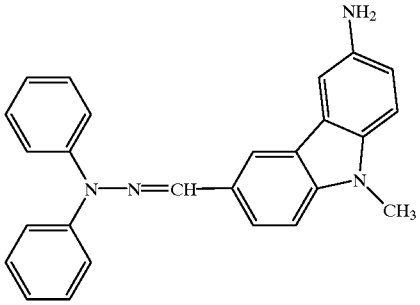

W-3

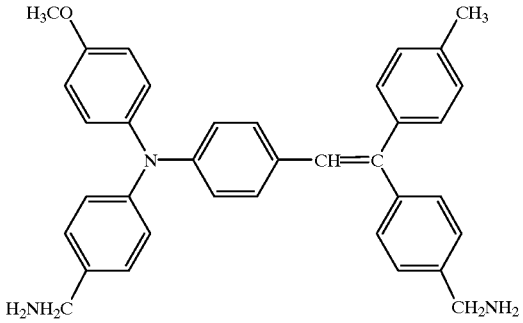

W-4

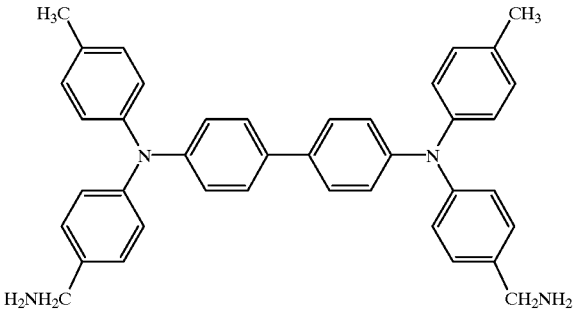

W-5

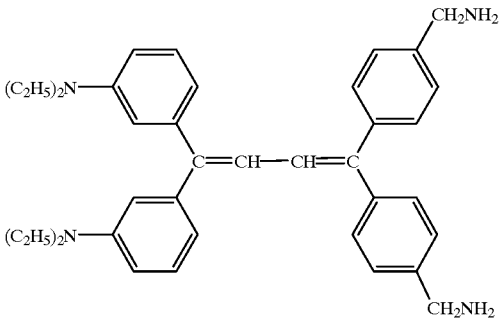

-continued

W-6

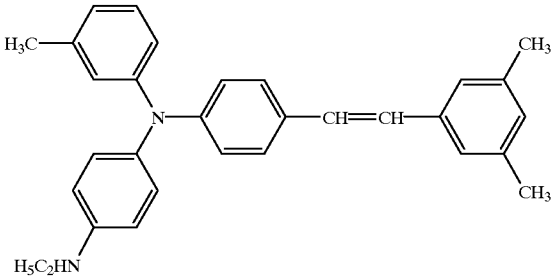

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

Further, transportable compounds having a group containing silicone atom are illustrated below.

The charge transportable compounds having a group containing silicone atom are charge transport compounds having following structure. The compound is contained in a polysiloxane hardenable resin as a partial structure through silicone atom in the molecule.

$$X—(—Y—Si(R_{11})_{3-a}(R_{12})_a))_n$$

wherein

X: a group containing structural unit providing charge transportability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of 1 to 3, and n: an integer.

Of these, representative compounds are such as those described below.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component i show similar effects to those of the component A+B, respectively. A too small amount of component F causes lowering in the sensitivity and rai sing in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octenate, dibutyl tin dictate, dibutyl tin dilaurate, dibutyl tin mercaptide, dibutyl tin thiocarboxylate and dibutyl tin maleate, an aluminum or zinc salt of octenoic acid or naphthenic acid and an acetylacetone complex.

Further, antioxidants having a partial structure of hindered phenol, hindered amine, thioether, or phosphite may be incorporated into the resin layer of the present invention, and are effective for the improvement of preventing occurrence of fogging and blurring of image in high temperature and high moisture condition. Particularly hindered phenol and hindered amine antioxidants are effective for such improvement of preventing occurrence of fogging and blurring of image in high temperature and high moisture condition.

Content of the antioxidant such as hindered phenol or hindered amine is preferably 0.01 to 10 weight % in the resin layer. In case of the content of not more than 0.01 weight %, sufficient effect for the improvement of preventing occurrence of fogging and blurring of image in high temperature and high moisture condition is not expected. In case of the content of more than 10 weight %, charge transportation ability decreases, residual potential becomes apt to increase and film strength degrades.

The antioxidant may be incorporated in the lower layer such as charge generation layer, charge transportation layer or inter layer if necessary. Content of addition of the antioxidant is preferably 0.01 to 10 weight % in the layer.

The hindered phenols as described herein means compounds having a branched alkyl group in the ortho position relative to the hydroxyl group of a phenol compound and derivatives thereof. (The hydroxyl group may be modified to an alkoxy group.)

Further, listed as hindered amines are compounds having an organic group represented by the following structural formula:

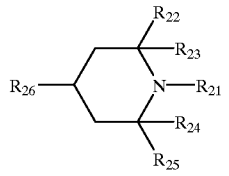

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I.No. 1-118137 (on pages 7 to 14).

Listed as antioxidants having a partial hindered amine structure are compounds described in JP O.P.I.No. 1-118138 (on pages 7 to 9).

The organic phosphor compounds, for example, represented by formula of RO—P(OR)—OR, include those listed below. R is hydrogen, alkyl, alkenyl, or aryl group each of which may have a substituent.

The organic sulfur compounds, for example, represented by formula of R—S—R, include those listed below. R is hydrogen, alkyl, alkenyl, or aryl group each of which may have a substituent.

Representative examples are listed.

1-1

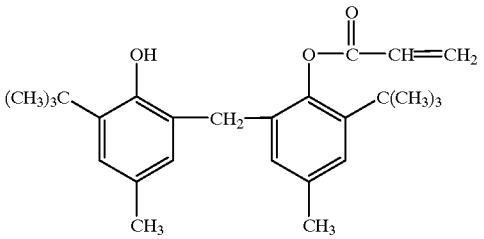

1-2

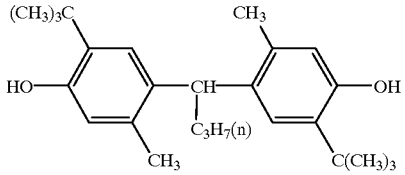

-continued
1-3
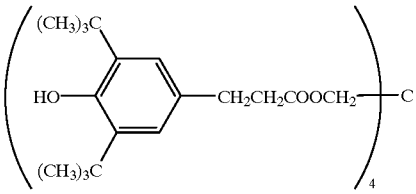
1-4
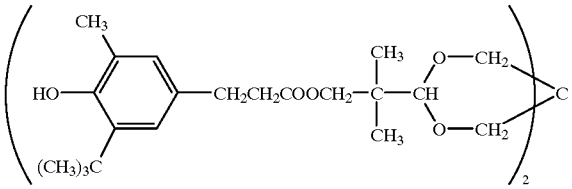
1-5
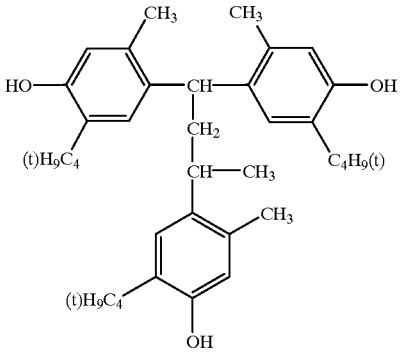
1-6
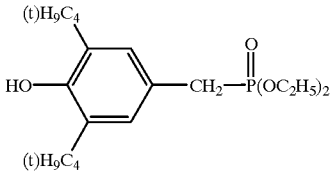
1-7
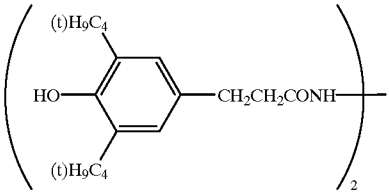
1-8
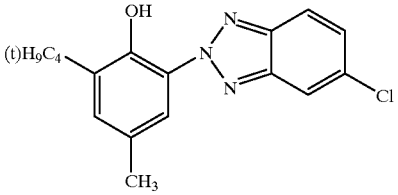
1-9
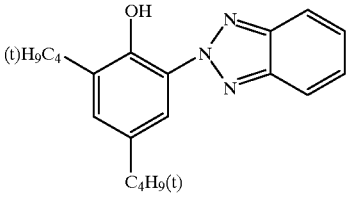
1-10
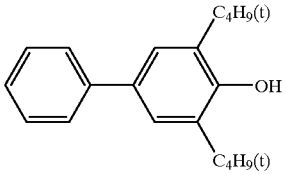
2-1
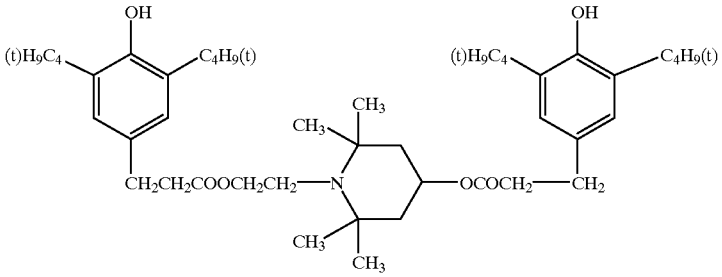

-continued
2-2
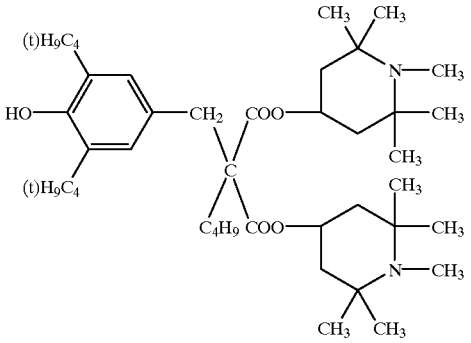
2-3
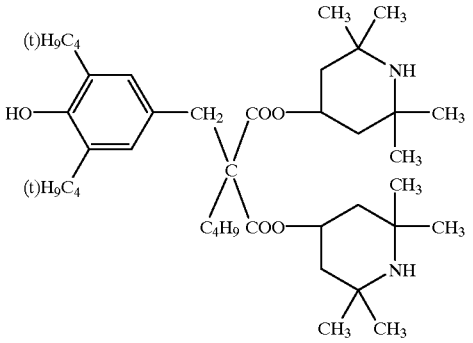
2-4
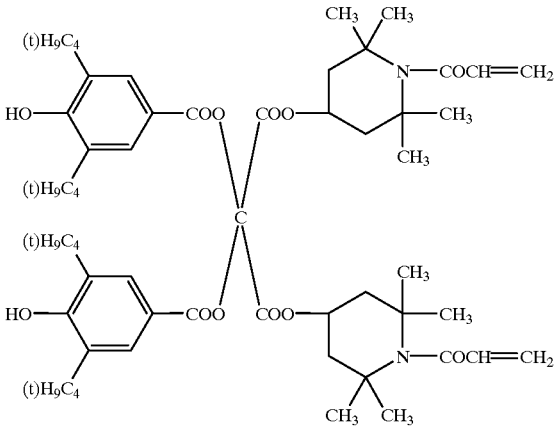
2-5
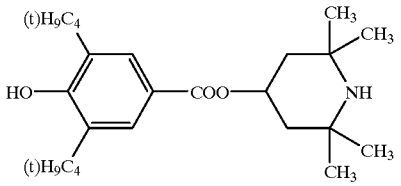
2-6
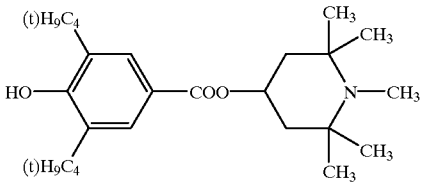
2-7
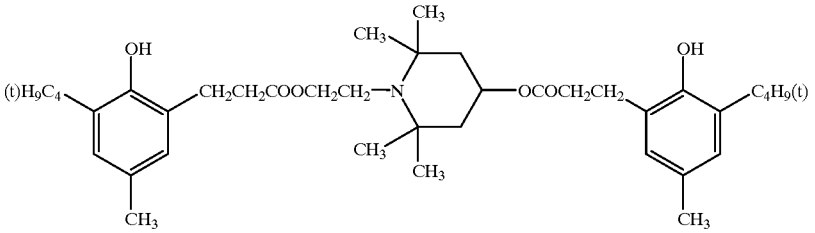
3-1
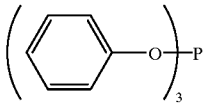
3-2
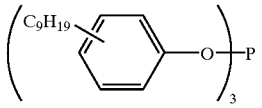
3-3
$(C_2H_5O)_3P$
3-4
$(C_8H_{17})_3P$
3-5
$(C_{10}H_{21}O)_3P$
3-6
$(C_{13}H_{27}O)_3P$
3-7
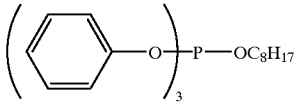
3-8
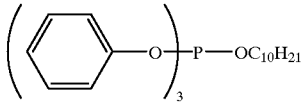

-continued 3-9

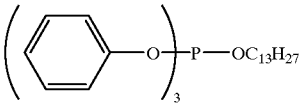

3-10

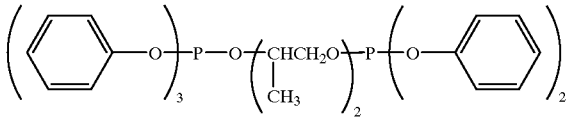

3-11

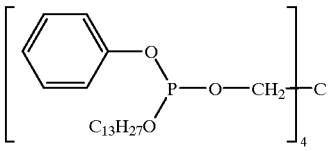

3-12

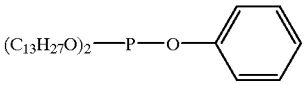

4-1

$(C_8H_{17}OCOCH_2CH_2)_2S$ 4-2

$(C_{10}H_{21}OCOCH_2CH_2)_2S$ 4-3

$(C_{12}H_{25}OCOCH_2CH_2)_2S$ 4-4

$(C_{14}H_{29}OCOCH_2CH_2)_2S$ 4-5

$(C_{18}H_{37}OCOCH_2CH_2)_2S$ 4-6

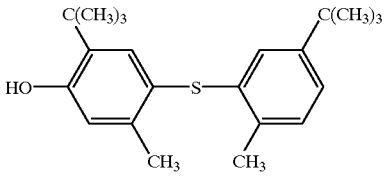

Examples of antioxidant available on the market include the followings.

Hindered phenol type antioxidant: Ilganox 1076, Ilganox 1010, Ilganox 1098, Ilganox 245, Ilganox 1330, Ilganox 3114, Ilganox 1076, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Organic Fine Particle

The organic fine particles have average volume diameter of 0.05 to 10 $\mu$m, preferably 0.1 to 5 $\mu$m. They are added in a resin layer of the photoreceptor in an amount of 0.01 to 50 weight %. Examples of the organic fine particles include resin fine particles of polytetrafluoroethylene, polychlorotrifluoroethylene, polyfluoridevinylidne, polyfluoroethylene, polydichlorodifluoroethylene, tetrafluoroethylene-perfluoroalkylvinylether copolymer, tetrafluoroethylene-hexafluoropropylene copolymer, tetrafluoroethylene-ethylene copolymer, tetrafluoroethylene-hexafluoropropylene-perfluoroalkylvinylether copolymer, silicone resin, polyethylene, polypropylene and melamine. Among those resin fine particles containing fluorine atom are preferable. Cleaning of residual toner becomes easy by incorporating the resin fine particles containing fluorine atom in the resin layer.

The content of these fine organic particles in the aforementioned resin layer is preferably determined so that the static friction coefficient of the aforementioned elastic body rubber plate employed in the present invention to the photoreceptor is no more than 1.0. By controlling said static friction coefficient at no more than 1.0, the generation of curl of the cleaning blade is minimized and the residual toner is readily removed.

Said static friction coefficient $\mu$, when said photoreceptor is shaped into a sheet, flat plate or endless belt, is measured employing a Surface Property Test Apparatus (Type Heidon-14), manufactured by Heidon Co.

On the other hand, in practice, photoreceptors installed in an electrophotographic image forming apparatus are mainly a drum. In this case, said static friction coefficient R is obtained by measuring rotation torque T (in Kg·cm) of said photoreceptor drum.

Namely, rotation torque T, (in kg·cm) of the photoreceptor drum itself, and rotation torque $T_2$ of the photoreceptor drum, in pressure contact with a blade cleaning member at a load F (in kg) are measured, and thus the static friction coefficient is obtained, employing the formula described below.

$$\text{Static friction coefficient}=(T_2-T_1)/(F\cdot\gamma)$$

wherein $\gamma$ is the radius (in cm) of the photoreceptor drum.

T1 (kg·cm): The driving torque of the brush roller when of the brush roller is not touched the photoreceptor $T_2$ (kg·cm): The driving torque of the brush roller when of the brush roller is pressed by blade cleaning means with weight og F (kg) to the photoreceptor.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, phthalocyanine pigments, polyring quinone pigments, azo pigments, perylene pigments, indigo pigments, quinacridone pigments, azulenium pigments, squarilium dyes, cyanine dyes, pyrylium dyes, thiopyrylium dyes, xanthene dyes, triphenylmethane dyes, styryl dyes etc. The CGM is employed solely or in combination with suitable binder resin to form a layer.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:10 and 10:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 10:1 and 1:10 in terms of weight ratio.

The thickness of the charge transport layer is preferably between 5 and 50 $\mu$m, and is more preferably between 10 and 40 $\mu$m. Furthermore, when a plurality of charge transport layers are provided, the thickness of the upper charge transport layer is preferably no more than 10 $\mu$m, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention is:

1) metal plates such as an aluminum plate, a stainless steel plate, and the like
2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

The electrically conductive support may have an anodized aluminum film subjected to heat-sealing processing.

The shape of the electrically conductive support may be drum, sheet or belt form, suitable for the electrophotographic apparatus.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in JP O.P.I.Nos. 3-90250 and 3-269238, while the above-mentioned circular amount control type coating is detailed in, for example, JP O.P.I.No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in JP O.P.I.No. 9-68870. The thickness of the interlayer is preferably between 0.1 and 10 $\mu$m, and is most preferably between 0.1 and 5 $\mu$m.

In the photoreceptor of the invention a conductive layer may be provided between the support and the inter layer for the purposes of providing a coating to compensate surface defects of the surface of the support and preventing of occurrence of interference mottle which becomes problematic when the image writing source is laser light. The conductive layer can be formed by coating a composition in which conductive powder such as carbon black, metal particles or metal oxide particles are dispersed in suitable binder resin and drying it. The thickness of the conductive layer is preferably 5 to 40 $\mu$m, particularly 10 to 30 $\mu$m.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

Figure 4:
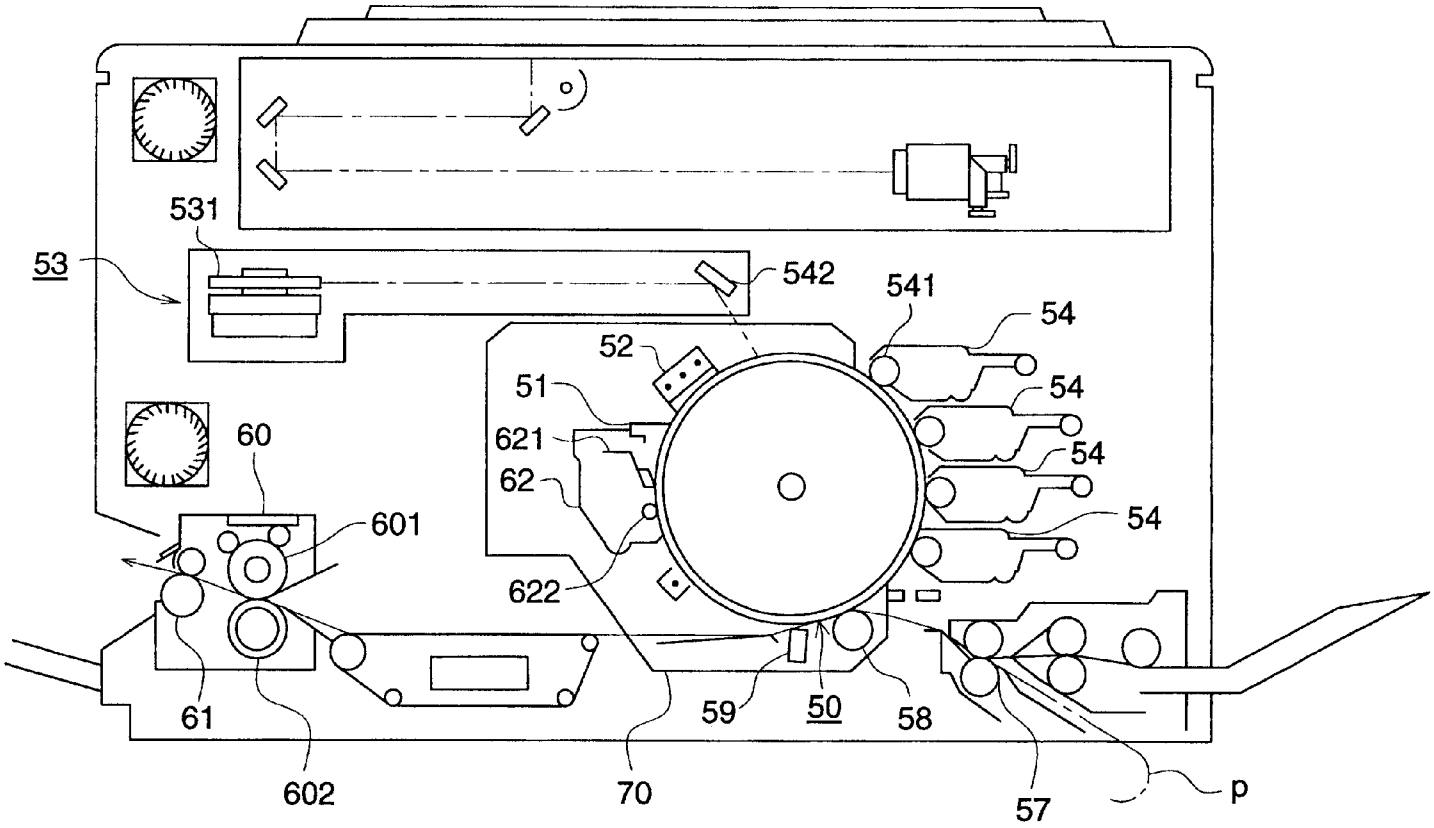
FIG. 4 shows a cross sectional view of an example of the electrophotographic image forming apparatus.

FIG. 4 shows a cross-sectional view of an image forming apparatus comprising the electrophotographic photoreceptor of the present invention.

In FIG. 4, reference numeral 50 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 52 is a scorotron charging unit, and the circumferential surface of the photoreceptor drum 50 is uniformly charged through corona discharge. Prior to charging with the use of this charging unit 52, the charge on the circumferential surface of the photoreceptor may be removed by exposure from exposure section 51 employing light-emitting diodes in order to eliminate the hysteresis of the photoreceptor due to the most recent image formation.

After the photoreceptor is uniformly charged, image exposure is carried out based on image signals employing image exposure unit 53. The image exposure unit 53 in FIG. 4 employs a laser diode (not shown) as the exposure light source. Scanning on the photoreceptor drum is carried out by light of which optical path is bent by reflection mirror 532 after the light has passed through rotating polygonal mirror 531, fθ lens, and the like, and an electrostatic image is formed.

The resulting electrostatic latent image is subsequently developed by development units 54. Around the photoreceptor drum 50, development units 54 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 50 and the development sleeve 541.

In the case of color image formation, after visualizing the first color image, the second color image formation is started. Uniform charging is again carried out employing the scorotron charging unit 52, and the second color latent image is formed by the image exposure unit 53. The third and fourth color images are formed by the same image forming processes as those for the second color image, and four color images are visualized on the circumferential surface of the photoreceptor drum 50.

On the other hand, in a monochromatic electrophotographic apparatus, the development unit 54 comprises only black toner and single development forms an image.

After forming an image, recording sheet P is supplied to a transfer zone employing the rotation of paper feeding roller 57 when transfer timing is adjusted.

In the transfer zone, transfer roller (in the transfer unit) 58 is brought into pressure contact with the circumferential surface of the photoreceptor drum 50 in synchronized transfer timing, and multicolor images are simultaneously transferred onto the recording sheet which is appropriately placed.

Subsequently, the recording sheet is subjected to charge elimination employing separation brush (in the separation unit) 59 which is brought into pressure contact at almost the same time when the transfer roller is brought into pressure contact, is separated from the circumferential surface of the photoreceptor drum 50, is conveyed to a fixing unit 60, is subjected to melt adhesion of the toner which is heated and pressed by heating roller 601 and pressure roller 602, and is then ejected to the exterior of the apparatus via paper ejecting roller 61. Incidentally, the above-mentioned transfer roller 58 and the separation brush 59, after passing the recording sheet P, withdraw from the circumferential surface of the photoreceptor drum 11 and are prepared for the subsequent formation of a new toner image.

On the other hand, the photoreceptor drum 50, from which the recording sheet P has been separated, is subjected to removal and cleaning of the residual toner through pressure contact of the blade 621 of cleaning unit 62, is again subjected to charge elimination employing the exposure section 51, subjected to recharging employing the charging unit 52, and subjected to a subsequent image forming process. Further, when color images are formed upon being superimposed on the photoreceptor, the above-mentioned blade 621 is immediately withdrawn after cleaning the photoreceptor surface of the photoreceptor drum.

Further, reference numeral 70 is a detachable cartridge in which a photoreceptor, a transfer unit, a separation unit, and a cleaning unit are integrated.

The electrophotographic image forming apparatus is constituted in such a manner that components such as the above-mentioned photoreceptor, development unit, cleaning unit the like are integrated as a cartridge, and this unit may be detachable from the main body.

Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

The process cartridge includes, in general, an integrated type cartridge and a separate type cartridge mentioned below. The integrated type cartridge is composed of at least one of a charging unit, an image exposure unit, a development unit, a transfer or separation unit and a cleaning unit with a photoreceptor integrally into one body, and it is arranged to be detachable to the apparatus main body. The separated type is composed of a charging unit, an image exposure unit, a development unit, a transfer or separation unit and a cleaning unit separated from a photoreceptor, and it is arranged to be detachable to the apparatus main body, and photoreceptor is made integrated into one body when the cartridge is built in main body. The process cartridge includes both types in the invention.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

EXAMPLES

A photoreceptor was prepared in the following manner.

Preparation of Photoreceptor 1

<Inter layer>

| | |
|---|---|
| Polyamide resin (Amiran CM-8000, manufactured by Toray Co., Ltd.) | 60 g |
| Methanol | 1600 ml |
| 1-butanol | 400 ml |

The above mentioned components are mixed and dissolved to prepare an interlayer coating liquid. The coating layer was coated by an immersion coating method on a cylindrical aluminum substrate having a diameter of 80 mm and a length of 360 mm so as to form an interlayer having a thickness of 0.3 μm.

<Charge generation layer>

| | |
|---|---|
| Titanylphthalocyanine | 60 g |
| Silicone resin solution (15% xylene-butanol solution of KR5240, manufactured by Shin'etsu Kagaku Co., Ltd.) | 700 g |
| 2-butanone | 2000 ml |

The above-mentioned components were mixed and dispersed for 10 hours using a sand mill to prepare a charge generation layer coating liquid. The coating liquid was coated of the interlayer by an immersion method so as to form a charge generation layer having a thickness of 0.2 μm. The X-ray diffraction spectrum of titanylphthalocyanine was measured, and the maximum peak was found at a Bragg's angle 2θ of 27.2°.

<Charge transport layer>

| | |
|---|---|
| 4-methoxy-4'-(4-methyl-α-phenylstyryl)triphenylamine | 200 g |
| Bisphenol Z type polycarbonate (IUPILON Z-300, manufactured by Mitsubishi Gas Kagaku Co., Ltd.) | 300 g |
| 1,2-dichloroethane | 2000 ml |

The above-mentioned components were mixed and dissolved to prepare a charge transport layer coating liquid. The coating liquid was coated on the foregoing charge generation layer by an immersion coating method to form a charge transport layer having a thickness of 25 μm.

<Resin layer>

| | |
|---|---|
| Trimethoxymethylsilane | 180 g |
| 1-butanol | 280 ml |
| 1% acetic acid aqueous solution | 106 ml |

The above-mentioned components were mixed and stirred for 2 hours at 60° C., and 370 ml of 1-butanol was added to the mixture and further stirred for 48 hours.

To the liquid, 67.5 g of dihydroxymethyltriphenylamine (exemplified compound T-1), 1.7 g of antioxidant Sanol LS2626, manufactured by SANKYO CO., LTD., and 4.5 g of dibutyl stannous acetate were added and mixed. Thus obtained liquid was coated to form a resin layer having a dry thickness of 1 μm and hardened for 1 hour at 120° C., to prepare Photoreceptor 1 to be used in example.

Preparation of Photoreceptor 2

Photoreceptor 2 was prepared in the same manner as in Photoreceptor 1 except that dihydroxymethyltriphenylamine was replaced by 4-[2-(triethoxysilyl)ethyl]triphenylamine. The photoreceptor 2 comprised a resin layer containing siloxane resin having structural unit having charge transportability and crosslinking structure.

Preparation of Photoreceptor 3

The interlayer, the charge generation layer and the charge transport layer were provided in the same manner as in Photoreceptor 1.

<Resin layer>

| | |
|---|---|
| Trimethoxymethylsilane | 120 g |
| γ-glycidoxypropyltrimethoxysilane | 60 g |
| 1-butanol | 280 ml |
| Acetic acid aqueous solution (1%) | 106 ml |

The above-mentioned components were mixed and stirred for 2 hours at 60° C. Then 370 ml of 1-butanol was added to the liquid and the mixture was further stirred for 48 hours.

To the liquid, 60 g of exemplified compound S-2, 10 g of fine particle of PTFE, Ruburon L2, manufactured by DAIKIN INDUSTRIES LTD., having an average diameter of 0.2 μm and 4.5 g of dibutyl stannous acetate were added and stirred. Thus obtained liquid was coated so as to form a resin layer having a thickness of 1 μm. The coated layer was subjected to hardening treatment by heating for 1 hour at 120° C. to prepare Photoreceptor 3, which comprised a resin layer containing siloxane resin having structural unit having charge transportability and crosslinking structure.

Preparation of Photoreceptor 4

The interlayer, the charge generation layer and the charge transport layer were prepared in the same manner as in Photoreceptor 1.

<Resin layer>

| | |
|---|---|
| Trimethoxymethylsilane | 120 g |
| γ-glycidoxypropyltrimethoxysilane | 60 g |
| 1-butanol | 280 ml |
| Acetic acid aqueous solution (1%) | 106 ml |

The above-mentioned components were mixed and stirred for 2 hours at 60° C. Then 370 ml of 1-butanol was added to the liquid and the mixture was further stirred for 48 hours.

To the liquid, 60 g of exemplified compound H-1, 10 g of fine particle of PTFE, Lubron L2, manufactured by DAIKIN INDUSTRIES LTD., having an average diameter of 0.2 μm and 100 g of colloidal silica (methanol suspension having a solid content of 30%) were added and stirred. Thus obtained liquid was coated so as to form a resin layer having a thickness of 1 μm. The coated layer was subjected to hardening treatment by heating for 1 hour at 120° C. to prepare Photoreceptor 4, which comprised a resin layer containing siloxane resin having structural unit having charge transportability and crosslinking structure.

Preparation of Photoreceptor 5

Photoreceptor 5 was prepared in the same manner as in Photoreceptor 1 except that hydroxymethyltriphenylamine (exemplified compound T-1) in the resin layer was omitted.

Preparation of Photoreceptor 6

Photoreceptor 6 was prepared in the same manner as in Photoreceptor 1 except that the resin layer was omitted.

Example (12 examples in all)

The photoreceptors 1 to 6 prepared as above-mentioned were each installed in a modified digital copy machine Konica 7050, manufactured by Konica Corporation. The copy machine has a laser exposure process and a reverse developing process.

Test of 50,000 sheets copying was conducted at 20° C., and 50% RH.

A cleaning blade having a rubber hardness and a repulsion elasticity shown in Table was mounted so as to have free length of 9 mm and to touch to the photoreceptor in the counter direction of the rotation direction of the photoreceptor with a touching angle of 20° and a pressure of 20 g/cm.

Image quality and cleaning characteristics of remaining toner and blade warping at 50,000th copying were evaluated and the result is summarized in Table.

TABLE 1

| Example No. | Photoreceptor No. | Hardeness (Degree) | Impact Resilience | Vibration amplitude (μm) | Worn thickness (μm) | Definition (lines/mm) | Coefficient of friction | Image Quality Density | Image Quality Fog | Cleaning of remaining toner | Blade warping |
|---|---|---|---|---|---|---|---|---|---|---|---|
| Inv. 1 | 1 | 70 | 60 | 175 | 0.4 | 6 | 0.63 | A | B | A | None |
| Inv. 2 | 1 | 70 | 28 | 40 | 0.23 | 6 | 0.38 | A | A | A | None |
| Inv. 3 | 1 | 67 | 52 | 180 | 0.37 | 6 | 0.74 | A | B | A | None |
| Inv. 4 | 1 | 65 | 45 | 95 | 0.28 | 6 | 0.49 | A | A | A | None |
| Inv. 5 | 1 | 77 | 56 | 122 | 0.43 | 6 | 0.55 | A | B | A | None |
| Inv. 6 | 2 | 70 | 60 | 185 | 0.45 | 5 | 0.84 | A | B | A | None |
| Inv. 7 | 3 | 70 | 60 | 37 | 0.28 | 6 | 0.25 | A | B | A | None |
| Inv. 8 | 4 | 70 | 60 | 53 | 0.34 | 6 | 0.33 | A | B | A | None |
| Com. 1 | 1 | 70 | 19 | 8 | 0.58 | 5 | 0.42 | A | D | C | None |
| Com. 2 | 1 | 70 | 77 | 256 | 0.26 | 4 | 1.29 | A | C | C | Twice |
| Com. 3 | 5 | 70 | 60 | 122 | 0.53 | 4 | 1.52 | B | D | C | 5 times |
| Com. 4 | 6 | 70 | 60 | 122 | 2.56 | 5 | 0.66 | B | B | C | None |
| Com. 5 | 6 | 70 | 77 | 207 | 5.87 | 5 | 0.71 | B | D | C | None |

Inv.: Example of Invention.
Com.: Example of Comparison

The evaluation was performed by taking 50,000 copies of an original image, having a pixel ratio of 7%, including a character, a portrait photograph, a solid white image and a solid black image. The size of image was A4 and the copy was carried out in an interval mode. The quality of solid white image, solid black image and occurrence of insufficient cleaning were evaluated on every 1,000 copies. The occurrence of insufficient cleaning was evaluate by the number of copy on which 5 or more white spots having a diameter of 0.3 mm or more were formed in the solid black image. Regarding the image density, the absolute reflective density was measured by a densitometer RD-918 manufactured by Macbeth Co., Ltd., and the density of the initial copy and that of the 50,000th copy were compared. Regarding the fogging, the fog in the solid white image was visually evaluated on the initial copy and the 50,000th copy.

The warping of the blade was evaluated by the number of occurrence of warping in the course 50,000 copies.

Image density

A: Not less than 1.2: Good

B: From less than 1.2 to 0.8: acceptable for practical use

C: Less than 0.8: Not acceptable for practical use

Fog

A: No fogging

B: Fog was occurred at times.

C: Fog was occurred continuously.

Occurrence of insufficient cleaning

A: Number of copy having white spots was not more than 5 per 50,000 copies.

B: Number of copy having white spots was within the range of from 6 to 20 per 50,000 copies.

C: Number of copy having white spots was 21 or more per 50,000 copies.

Table 1 shows that in the test of comparative samples 4 and 5, employing conventional photoreceptor having polycarbonate at the surface, image quality such as density, fog and cleaning characteristics are acceptable at the initial stage of copying, however, worn thickness after 50,000 copying was much more than those of examples of the invention 1–8. The worn thickness of these comparative samples was ten times ore more in comparison with the inventive samples in spite of employing the cleaning condition such as amplitude of blade vibration and impact resilience satisfying the stipulation of the invention. In comparative samples 4 and 5, the photoreceptor worn out due to copying and image quality deteriorates. Further, blade condition for the conventional photoreceptor prevented blade warping, however, control of image quality was difficult.

In comparative sample 3, employing photoreceptor 5 fallen without of the scope of the invention, while the worn thickness was reduced, cleaning characteristics, image quality, particularly fog, and blade warping characteristics were deteriorated.

Comparative samples 1 and 2 employs similar photoreceptors to that of the present invention. In these samples, when the blade condition such as amplitude of blade vibration and impact resilience is not satisfied, image quality, cleaning characteristics and blade warping are not fully dissolved though worn thickness was acceptable.

Table 1 also shows that the examples 1 to 8 satisfying the requirement of the invention are clearly superior to the comparative examples 1 to 4 in the sufficient density, low fog and low occurrence of insufficient cleaning, and give excellent images without blade warping at 50,000 copying.

In inventive samples 1 to 8 the problem of image quality, cleaning characteristics and blade warping as well as wearing of the photoreceptor were dissolved by a combination of specific photoreceptor with blade condition. Particularly control of blade condition was not effective for a conventional photoreceptor as shown in comparative samples. However the combination of the specific photoreceptor with specific blade condition is extremely effective.

The electrophotographic image forming method, electrophotographic image forming apparatus, and the processing cartridge and electrophotographic photoreceptor to be used in the apparatus can be provided by which a copy image having a high durability and quality can be obtained.

What is claimed is:

1. An electrophotographic image forming method in which, after transferring a toner image on an electrophotographic photoreceptor onto a recording material, the residual toner on said photoreceptor is removed employing an elastic body rubber blade, wherein said photoreceptor has a resin layer comprising a siloxane based resin having a crosslinked structure and structural units exhibiting charge transport performance; said rubber blade is brought into contact with said photoreceptor in a counter position to a direction of rotation of said photoreceptor; and the residual toner on said photoreceptor is removed by said rubber blade vibrating at an amplitude of 10 to 200 $\mu$m.

2. An electrophotographic image forming method in which after transferring a toner image on an electrophotographic photoreceptor onto a recording material, the residual toner on said photoreceptor is removed employing an elastic body rubber blade, wherein said photoreceptor has structural units exhibiting charge transport performance; also has a resin layer comprising a siloxane based resin having a crosslinked structure; rubber of the rubber blade has an impact resilience at 25±0.2° C. between 20 and 75; said rubber blade is brought into contact with said photoreceptor in a counter position to a direction of rotation of said photoreceptor so that the residual toner on said photoreceptor thereby is removed.

3. The electrophotographic image forming method of claim 1 or 2 wherein static friction coefficient of said elastic body rubber blade with respect to said photoreceptor is no more than 1.0.

4. The electrophotographic image forming method of claim or 2 wherein the resin layer comprises fine organic particles having an average particle diameter of 0.05 to 10 $\mu$m.

5. The electrophotographic image forming method of claim 4 wherein the fine organic particles are those comprising fluorine atoms.

6. The electrophotographic image forming method of claim 1 or 2 wherein the resin layer comprises antioxidants.

7. The electrophotographic image forming method of claim 1 or 2 wherein the resin layer of said photoreceptor is comprised of a siloxane based resin which is obtained through reaction of an organic silicon compound having a hydroxyl group or a hydrolyzable group with a charge transferring compound having a hydroxyl group.

8. The electrophotographic image forming method of claim 2 wherein said rubber blade is vibrating at an amplitude of 10 to 200 $\mu$m during removing residual toner.

9. The electrophotographic image forming method of claim 2 wherein said rubber is polyurethane rubber.

10. The electrophotographic image forming method of claim 2 wherein the rubber blade has hardness at 25±5° C. between 65 and 80 in terms of JIS A Scale.

11. An electrophotographic image forming apparatus in which, after transferring a toner image on an electrophotographic photoreceptor onto a recording material, the residual toner on said photoreceptor is removed employing an elastic body rubber blade, wherein said photoreceptor has a resin layer comprising a siloxane based resin having a crosslinked structure and structural units exhibiting charge transport performance; said rubber blade is brought into contact with said photoreceptor in a counter position to a direction of rotation of said photoreceptor; and the residual toner on said photoreceptor is removed by said rubber blade vibrating at an amplitude of 10 to 200 $\mu$m.

12. An electrophotographic image forming apparatus in which, after transferring a toner image on an electrophotographic photoreceptor onto a recording material, the residual toner on said photoreceptor is removed employing an elastic body rubber blade, wherein said photoreceptor has structural units exhibiting charge transport performance; also has a resin layer comprising a siloxane based resin having a crosslinked structure; rubber of the rubber blade has an impact resilience at 25±0.2° C. between 20 and 75; said rubber blade is brought into contact with said photoreceptor in a counter position to a direction of rotation of said photoreceptor so that the residual toner on said photoreceptor thereby is removed.

13. A processing cartridge employed in an electrophotographic image forming apparatus in which, after transferring a toner image on an electrophotographic photoreceptor onto a recording material, the residual toner on said photoreceptor is removed employing an elastic body rubber blade, wherein the processing cartridge integrally comprises at least an electrophotographic photoreceptor having a resin layer containing a siloxane based resin having a crosslinked structure and a cleaning means in which an elastic body rubber blade employing urethane rubber having an impact resilience at 25±0.2° C. between 20 and 75, and is detachably installed in said electrophotographic image forming apparatus.

* * * * *